US006204767B1

(12) United States Patent
Sparks

(10) Patent No.: US 6,204,767 B1
(45) Date of Patent: Mar. 20, 2001

(54) CHAIR MONITOR

(75) Inventor: Brian J. Sparks, Milwaukee, WI (US)

(73) Assignee: Donald A. Edwards, Mequon, WI (US)

( * ) Notice: Subject to any disclaimer, the term of this patent is extended or adjusted under 35 U.S.C. 154(b) by 0 days.

(21) Appl. No.: 09/326,430

(22) Filed: Jun. 4, 1999

(51) Int. Cl.[7] ..... G08B 23/00

(52) U.S. Cl. ..... 340/573.1; 340/573.7; 340/686.1; 340/686.6; 367/93; 367/99

(58) Field of Search ..... 340/573.1, 686.6, 340/686.1, 573.7, 575, 667, 552, 555, 435, 903; 180/735; 250/222.1; 128/781; 367/99, 93

(56) References Cited

U.S. PATENT DOCUMENTS

| | | | | |
|---|---|---|---|---|
| 3,961,201 | | 6/1976 | Rosenthal | 307/116 |
| 3,991,746 | | 11/1976 | Hanna | 128/2 |
| 4,175,263 | | 11/1979 | Triplett et al. | 340/573 |
| 4,179,692 | | 12/1979 | Vance | 340/573 |
| 4,196,425 | | 4/1980 | Williams, Jr. et al. | 340/573 |
| 4,197,528 | * | 4/1980 | Gibson | 367/93 |
| 4,203,098 | * | 5/1980 | Muncheryan | 340/575 |
| 4,242,672 | | 12/1980 | Gault | 340/573 |
| 4,295,133 | | 10/1981 | Vance | 340/573 |
| 4,484,043 | | 11/1984 | Musick et al. | 200/85 R |
| 4,565,910 | | 1/1986 | Musick et al. | 200/85 R |
| 4,583,084 | | 4/1986 | Henderson et al. | 340/573 |
| 4,633,237 | | 12/1986 | Tucknott et al. | 340/573 |
| 4,750,584 | * | 6/1988 | Tanaka et al. | 181/68 |
| 4,858,622 | | 8/1989 | Osterweil | 128/782 |
| 4,890,266 | * | 12/1989 | Woodward | 367/99 |
| 4,907,845 | | 3/1990 | Wood | 340/573 |

(List continued on next page.)

OTHER PUBLICATIONS

Advertisement for Posey Personal Alarm, p. 14.

Advertisement for Tabs Mobility Monitor, *Provider* Magazine, Sep., 1998, p. 96.

Article for Tabs Mobility Monitor, pp. 1–2.

Posey Healthcare Products Guide, Prevent Falls Without Resorting to Restraints. 2 pages.

Advertisement for Bed–Check Corporation, p. 6, *Contemporary Long Term Care* Magazine.

Bed–Check Control Unit information sheet.

*Primary Examiner*—Benjamin C. Lee
*Assistant Examiner*—Phung Nguyen
(74) *Attorney, Agent, or Firm*—Boyle Fredrickson Newholm Stein & Gratz SC

(57) ABSTRACT

A chair monitoring system is used in a nursing home, hospital, healthcare facility or home or in a vehicle application, to detect an individual's attempted departure from a seat before the individual leaves the seat, or as an individual starts to slide out of a seated position. The purpose of this invention is to help prevent falls and provide an early alarm to enable caregivers, nursing staff, or another responsible individual to respond quickly and appropriately to reduce injuries. This alarm can be audible and visual at the chair and/or can trigger a nurse call system. A new technology is used to continually, invisibly, and remotely monitor a person's presence in a chair. There are no pads, strings, clips or attachments to the monitored person. The safe area can be easily adjusted to fit the specific needs of the situation and enable a caregiver to be alerted when a person slides down, leans forward or starts to leave the chair before he or she has physically left the chair. Any size or weight person can be monitored. Electronic technology is used to accurately detect the distance without physically touching the monitored person.

31 Claims, 3 Drawing Sheets

U.S. PATENT DOCUMENTS

| | | | | |
|---|---|---|---|---|
| 4,947,152 | | 8/1990 | Hodges | 340/573 |
| 4,949,074 | * | 8/1990 | D'Ambrosia et al. | 340/552 |
| 4,980,869 | * | 12/1990 | Forster et al. | 367/99 |
| 5,057,819 | | 10/1991 | Valenti | 340/573 |
| 5,066,943 | | 11/1991 | Demirel et al. | 340/573 |
| 5,144,284 | | 9/1992 | Hammett | 340/573 |
| 5,184,112 | | 2/1993 | Gusakov | 340/573 |
| 5,235,319 | | 8/1993 | Hill et al. | 340/573 |
| 5,410,297 | | 4/1995 | Joseph et al. | 340/573 |
| 5,469,861 | * | 11/1995 | Piscopo et al. | 128/781 |
| 5,471,198 | | 11/1995 | Newham | 340/573 |
| 5,494,046 | | 2/1996 | Cross | 128/782 |
| 5,500,526 | * | 3/1996 | Shalvi et al. | 250/222.1 |
| 5,519,380 | | 5/1996 | Edwards | 340/572 |
| 5,572,484 | * | 11/1996 | Gaus et al. | 367/99 |
| 5,600,305 | | 2/1997 | Stafford et al. | 340/573 |
| 5,602,542 | * | 2/1997 | Widmann | 340/903 |
| 5,603,127 | | 2/1997 | Veal | 4/246.1 |
| 5,635,905 | * | 6/1997 | Blackburn et al. | 340/555 |
| 5,654,694 | | 8/1997 | Newham | 340/573 |
| 5,872,507 | * | 2/1999 | Weber et al. | 340/435 |
| 5,914,660 | * | 6/1999 | Mesibov et al. | 340/573 |
| 5,943,295 | * | 8/1999 | Varga et al. | 367/99 |
| 5,990,799 | * | 11/1999 | Boon et al. | 340/667 |

* cited by examiner

CHAIR MONITOR

BACKGROUND OF THE INVENTION

1. Field of the Invention

The invention relates to a contactless monitoring system and, more particularly, to a monitoring system for monitoring an individual seated in a chair.

2. Discussion of the Related Art

As the population ages, an increasing number of people are developing dementia, or disorientation and are in nursing homes or home caregiving situations where falls from a stationary chair, wheelchair, couch, etc. can result in severe injuries. This type of situation is not only dangerous for the demented individual, but can also be very stressful to the caregiver or nursing staff. Since the nursing staff in most facilities or home caregivers cannot continually watch a person who may fall from a chair, they must rely on the assistance of monitors to alert them if a person attempts to leave the chair or has fallen out of it.

Patients in nursing homes and hospitals are often very frail and predisposed to falling. Unfortunately for these patients, the slightest fall may result in a severe, potentially permanent injury that may lead to the deterioration of a person's physical well being and ultimately to his or her death. Many of these falls occur because an individual attempts to stand or walk without assistance. In addition, people may fall asleep in a seated position and gradually slide down, slump or fall forward and then fall out of the seat. This situation is of utmost concern to nursing staffs in hospitals and nursing homes and to home caregivers because it is often difficult to detect the patient's change in condition unless a staff member or caregiver is sitting right next to the individual. Unfortunately, in this time of cost containment and cutbacks of medical personnel, it is often impossible to have a staff member assigned to only one patient. In addition, it is unrealistic to expect a home caregiver to be with a loved one twenty-four hours a day. Accordingly, a simple, inexpensive method of monitoring the movements of a seated patient without requiring a caregiver to constantly observe the patient or loved one is needed.

In addition, the use of the current monitoring systems is often limited to a home or medical facility. Because of the size and complexity of many monitoring systems, they cannot be easily transported or used in a contained area such as a car or other vehicle. Furthermore, the current monitoring systems cannot detect changes in the head and body position such as slumping, slipping or falling backwards, which are indicative of sleepiness and extremely significant for an individual seated in a chair and for the operator of a vehicle.

Numerous methods for preventing falls from chairs or at least for detecting such falls currently exist. For instance, physical restraints are commonly used to prevent the monitored person from exiting a chair, wheelchair or other seating apparatus. Although the use of physical restraints is effective in confining the individual to a specific area, the use of physical restraints results in physical and psychological side effects. These effects include psychological stress resulting from the individual's perceived loss of his or her of freedom and dignity, and physical injury resulting from struggling to be free of the restraints. Physical restraints obviously are of no use in vehicular applications.

Electronic monitoring devices help alleviate many of the physical and psychological side effects resulting from the use of physical restraints and have a wider range of uses. These monitoring systems generally fall into three major categories.

The first category of monitoring system is a weight or pressure detecting system that uses a pressure sensitive pad and controller to detect the weight of a person. To be detected, a person must sit on top of the pad and must be of adequate weight to compress contacts of the pad. Operation of the system depends upon the pad springing back into place when the person leaves the seat. The resulting mechanical action is detected with a mechanical or electronic piezoelectric switch, which sends a signal to a controller that triggers an alarm. There are many drawbacks to this type of system. The alarm is only activated if the monitored individual leaves the chair completely. It also does not provide any mechanism for detecting mere changes in the individual's position indicating an immanent departure. In addition, many of these systems have a time delay before the alarm is sounded to reduce nuisance alarms. Unfortunately, the time delay prevents the alarm from sounding until after the monitored person has already fallen. In addition, the monitoring pads must be replaced frequently because they are easily damaged and rendered inoperable. Pressure activated monitors are often ineffective for small and frail people or children because those people may not be heavy enough to compress the pressure pad sufficiently to activate the alarm.

The second category of monitoring devices or systems utilizes a physical attachment connected between a monitored individual and a controlling device. This system typically requires a clip and string or cord to be attached to the patient's clothes. The other end of the string is connected to a magnet or insert that plugs into the controlling device. When a person attempts to leave the chair, the insert is pulled out of the controlling device to trigger an alarm. There are many disadvantages to this monitoring system. The clip may be removed by the monitored individual, or it can simply fall off the monitored individual. If the clip is removed, the device is rendered ineffective. The string also needs to be of the proper length. If it is too long, it can wrap around the monitored individual and cut off circulation. The attached clip may cause a degree of discomfort that causes the monitored individual to try to remove it. Consequently, nursing staff and caregivers must continually check to make sure the clip is attached to the patient. If the insert is pulled out of the controller, the controller triggers an alarm. Once the alarm is activated, a staff member or caregiver must reset the device and reattach the insert and/or clip even if the monitored individual returns immediately to a seated position.

The third category of monitoring devices or systems use intensity-based measurements of transmitted energy beams to detect if the monitored person is moving into an unsafe area. Under this type of system, a transmitter is positioned in one location near the patient. A receiver is positioned in a second location so that it continually receives the transmitted beam when the patient is in a desired position. If the individual moves outside the desired position, the beam is broken and an alarm is triggered. Although this approach does not require any of the restrictive methods as required in the two previous categories and has a wider range of applications, it only indicates the presence or absence of the monitored individual in the transmitted area. It cannot detect small changes in the patient's position, such as slumping.

OBJECTS AND SUMMARY OF THE INVENTION

It is therefore an object of the invention to provide a chair monitoring system which may be used by non-ambulatory persons of all sizes and weights and which does not require the person being monitored to actually leave the chair before generating an alarm. "Non-ambulatory," as used herein, is not limited to persons incapable of walking. Rather, a non-ambulatory" person is one who is in a chair or other confined space and who is not expected to walk or otherwise move from that space during the monitoring period.

It is another object of this invention is to provide a mechanism to reduce falls from a sitting position by generating an alarm before a person leaves the defined area or when the person starts to lean forward, slide down, or slump.

It is another object of this invention is to provide a fast and immediate alarm to enable caregivers to respond to an attempted egress before an injury occurs or the person has fallen.

It is another object of this invention to reduce the use of restraints and attachments.

It is another object of this invention is to provide an automatic reset when a monitored person returns to the safe area. The reset will occur if the patient immediately returns to the safe area, thus eliminating the need for the staff to respond to an attempted egress or slumping situation when the person has returned to the safe area. This eliminates nuisance alarms while enabling staff to respond to real departures.

It is another object of this invention is to provide an automatic reset that does not depend upon a mechanical action, weight or attachments to the person.

It is another object of this invention is to use new electronic technology to continually monitor a person's position and provide immediate feedback and alarm if a person starts to leave the safe area.

It is another object of the present invention to eliminate the effects of individual patient differences, such as differences in clothing color and type, on the effectiveness of the monitoring system.

It is another object of this invention is to improve safety, reduce nuisance alarms and allow the caregiver and nurses to adjust the distance of the safe area to accommodate the specific needs of the individual being monitored.

It is another object of this invention is to provide caregivers with an immediate warning without time delays between a change in the monitored individual's position and the alarm signal.

It is another object of this invention is to provide a monitor capable of monitoring low weight, frail people and children.

It is another object of this invention is to provide a monitoring system that does not require the use of physical restraints, clips, strings, wires or other devices that attach to the monitored person.

It is another object of this invention is to eliminate costly replacement pads and other mechanical means of monitoring a person in a chair.

It is another object of this invention is to provide a device that be readily used and mounted on a wheelchair, chair, vehicle headrest, commode, walker or couch.

These objects are achieved by providing a self-contained, contactless, chair mounted monitoring system that relies on a direct correlation between 1) the distance between a controller of the system and a monitored individual, and 2) an intensity-independent characteristic of the reflected signal. The distance could be measured, e.g., using pulse timing, phase comparison, or optical parallax, either static or dynamic.

For example, as the distance between the controller and individual increases, so does the return time of the reflected pulsed signal. Likewise, as the distance between the controller and the individual decreases, so does the return time of the reflected pulsed signal. Similar distance based correlations exist with respect to phase shift and angle of incidence and possibly other intensity-independent characteristics of the signal. An alarm signal is generated whenever the measured characteristic of the returned signal does not meet a threshold requirement. In time-based applications, the threshold will typically be set near the maximum return time in applications in which only chair egress is of a concern, but may also be a smaller return time in other applications in which slumping backwards or sideways is of a concern.

The system functions by placing the device having a transmitter and receiver, which may be combined in a single transducer, at a predetermined, settable distance from a monitored individual and transmitting a pulsed signal toward the individual at intervals. The transmitted beam is then reflected off the monitored individual and back to a receiver on the controller. The system then measures the return time, phase shift, or angle of incidence of the received signal and compares it to a preset range for the measured selected characteristic. The preset range corresponds directly to a three-dimensional predetermined space parameter selected by, e.g., a caregiver. The three-dimensional predetermined space parameter is essentially the space or area that is considered safe, or normally occupied by a person in a seated position. If the monitored individual goes outside of the three-dimensional predetermined space parameter, he or she is presumed to no longer be in a safe or normal position and should therefore be checked by the staff or caregiver.

The receiver is coupled to a circuit that measures an intensity-independent characteristic of each returned pulsed signal, such as the return time of the reflected transmitted signals, and compares it with the corresponding predetermined space parameter for the monitored individual. If the measured characteristic is outside the preset threshold parameter, the circuit triggers an alarm. In a caregiver application, the alarm signal alerts the medical staff or home caregiver that the patient is no longer within the predetermined space monitored by the system. In a vehicular application, the signal warns the driver that he or she is inattentive or falling asleep.

BRIEF DESCRIPTION OF THE DRAWINGS

Preferred exemplary embodiments of the invention are illustrated in the accompanying drawings in which like reference numbers are presented throughout, and in which.

DETAILED DESCRIPTION OF THE PREFERRED EMBODIMENTS

1. Resume

The present invention provides a self-contained contactless monitoring system for detecting undesired movement of a person seated in a chair. The monitoring system provides a safe and effective method of monitoring a seated individual without the use of any physical restraints or attachments. The monitoring system utilizes a monitoring method based upon a direct correlation between 1) a change in an intensity-independent characteristic of a pulsed signal generated by the controller and reflected from the individual and, 2) a change in the distance between the controller and the monitored individual. As the distance between the controller and individual increases, so does the measured characteristic of the reflected pulsed signal. Likewise, as the distance between the controller and the individual decreases, so does the measured characteristic. The measured characteristic may, for instance, be a phase shift between the transmitted and received signals, the angles of incidence of the received signal, or preferably, the return time of the received signals.

The Chair Monitor Device

Figure 1:
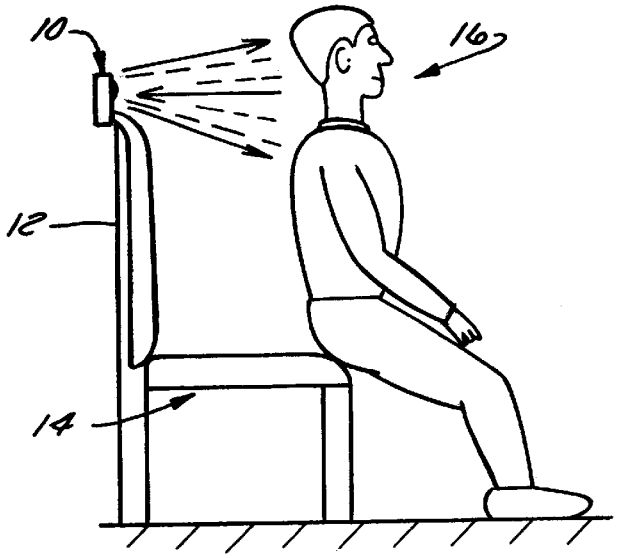
FIG. 1 schematically illustrates a contactless chair monitoring system constructed in accordance with a first embodiment of the invention.
Figure 4:
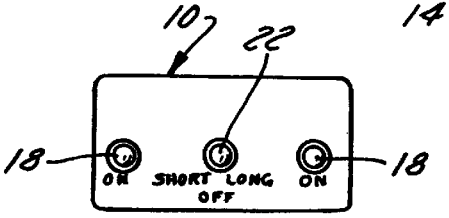
FIG. 4 is a top plan view of the monitor.
Figure 2:
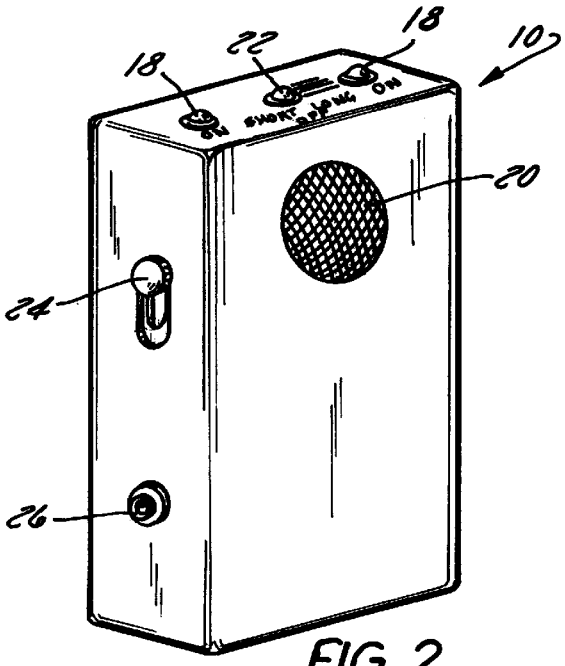
FIG. 2 is a perspective view of the monitor of the system, shown from the front of the monitor.
Figure 3:
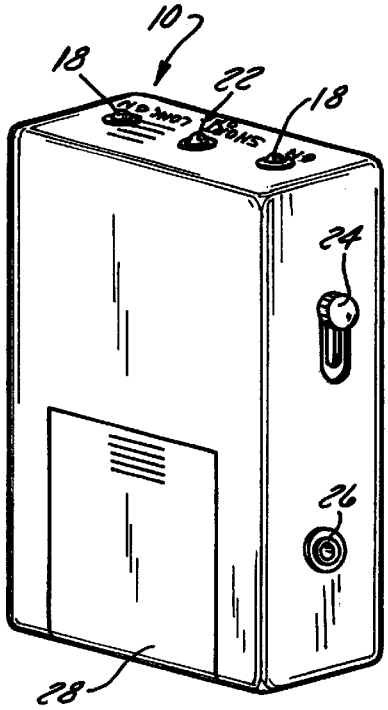
FIG. 3 corresponds to FIG. 2 and illustrates the rear of the monitor.
Figure 5:
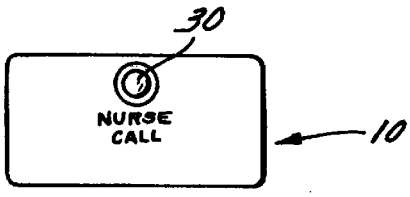
FIG. 5 is a bottom plan of the monitor.

Referring now to FIG. 1, a contactless patient monitoring system 10 constructed in accordance with the invention can easily be mounted onto the back 12 of a chair 14, such as a wheelchair, vehicle headrest or stationary chair, at a predetermined distance from an individual 16 to be monitored. The monitoring system is preferably mounted on the backrest 12 of a chair 14 behind the monitored individual 16 as depicted in FIG. 1, to reduce the possibility that the individual 16 will tamper with the monitoring system 10. The mounting location and mounting technique will vary from application to application. For instance, the patient monitoring system 10 can be mounted onto the backrest 12 of a high back seating apparatus, such as a vehicle seat, with a specially adapted cushioned headrest or lumbar support. The cushioned headrest (not shown) of such a seat has a compartment designed to receive the patient monitoring system 10. The compartment has a pouch or otherwise opens to the back of the headrest so that the patient monitoring system can easily be mounted within it. An aperture extends from the inner wall of the compartment through the front surface of the cushioned headrest. When the patient monitoring system 10 is housed within the compartment, the aperture aligns with a transducer of the monitoring system, allowing the transducer to transmit pulsed signals toward the monitored individual without interference. The headrest may also be mounted onto the backrest of a high back seating apparatus by slipping an adjustable strap secured to both sides of the headrest over the backrest and then tightening the straps into place.

Alternatively, the patient monitoring system can be mounted onto the backrest 12 of a low back seating apparatus such as a wheelchair or other chair 14. In this circumstance, an extension strip (not pictured) made of sturdy, resilient material, such as plastic or Plexiglas, can be secured onto the backrest 12 of the chair 14. The strip is formed into lower, middle and top sections that create a shelf for the cushioned headrest. The lower section, preferably about twelve inches long, is mounted directly onto the backrest 12 of the chair 14 and extends vertically toward the back of the monitored individual's head. The lower section is mounted onto the backrest 12 with VELCRO® or with mushroom head fastener strips attached to the front face of the lower section or with any other suitable connector. The middle section, preferably about three inches long, extends from the lower section at an angle of approximately 120°–135° so that the middle section creates a shelf designed to hold the patient monitoring system 10 when the extension strip is mounted onto the backrest 12 of the chair 14. In addition, the middle section has an aperture for accommodating wires connected to the patient monitoring system 10 if the system 10 is powered by an external source or connected to a nurse call system. The top section, also preferably about 3½ inches long, extends from the middle section at approximately a right angle essentially forming a back to the shelf created by the middle section. The patient monitoring system 10 is mounted on the shelf created by the middle section and top section of the extension strip, and secured on the back surface of the patient monitoring system 10 and the inner surface of the top section of the extension strip.

Referring now to FIGS. 2–6, the monitoring system 10 includes a controller 54 coupled to an alarm generator (not pictured) enclosed within a housing 15. The monitoring system 10 is lightweight and self-contained so that a monitored individual 16 is not in danger of becoming entangled in cords, connecting wires or the like. The monitoring system 10 may be powered by a battery enclosed within a compartment 28 of the housing 15 and/or via an external power source connecting to the housing 15 at a port 26. If the power to the patient monitoring system 10 is low, the alarm generator will generate a low battery tone to alert the caregiver or staff that the power is low.

The patient monitoring system 10 is turned on and off by a pair of buttons 18, preferably mounted on the top edge of the housing 15. Advantageously, the system can be activated by pushing only one of the buttons 18, but both buttons 18 must be pushed simultaneously to deactivate the system. This provides an additional safeguard to ensure the monitoring system 10 is not accidentally deactivated by the patient or staff member. In addition, the alarm generator will generate an alarm signal when the two buttons 18 are depressed so that any attempt to deactivate the system can be monitored. The alarm is automatically reset when the patient returns to the safe position or the system is turned off by depressing both buttons 18.

The controller 54 further includes a transducer 20, which is capable of transmitting and receiving pulsed signals periodically at a rate of approximately one signal per second at a frequency of 20–100 kHz. The pulsed signal may be infrared, sonic, ultrasonic, microwave or any other reflectable energy source, preferably sonar. The transducer preferably used in the patient monitoring system 10 is Polaroid's electrostatic transducer of environmental grade, 600 series, part #616342 & 607281 used in conjunction with a 6500 Series Transformer, part #619392 & 619391. The circuit is coupled with the receiver of the transducer 20 so as to measure an intensity-independent characteristic of the reflected signal and to compare it with preset threshold parameters.

For example, in the case of time-based measurements, the preset return time range is defined by and corresponds directly to the predetermined space parameter, indicating the maximum safe distance of the monitored individual from the transducer depending on the application. The distance may typically vary from within the range of approximately 0 inches to approximately 30 inches, but larger distances can be provided for special applications. The space parameters may be adjusted to new parameters with a long-short control 22 usable to set the circuit to recognize a return time range.

An alarm generator is coupled with the circuit to generate an alarm if the return time or other measurement characteristic measured by the circuit is outside the preset range. The alarm may be an audible or visible alarm provided on the controller, or may be a signal transmittable to a remote nurses call station. Parameters of the alarm, such as volume, duration, or pulse period, can be adjusted with the alarm setting switch 24 located on the side edge of the housing 15.

3. The Method of Monitoring an Individual with the Chair Monitor

Figure 6:
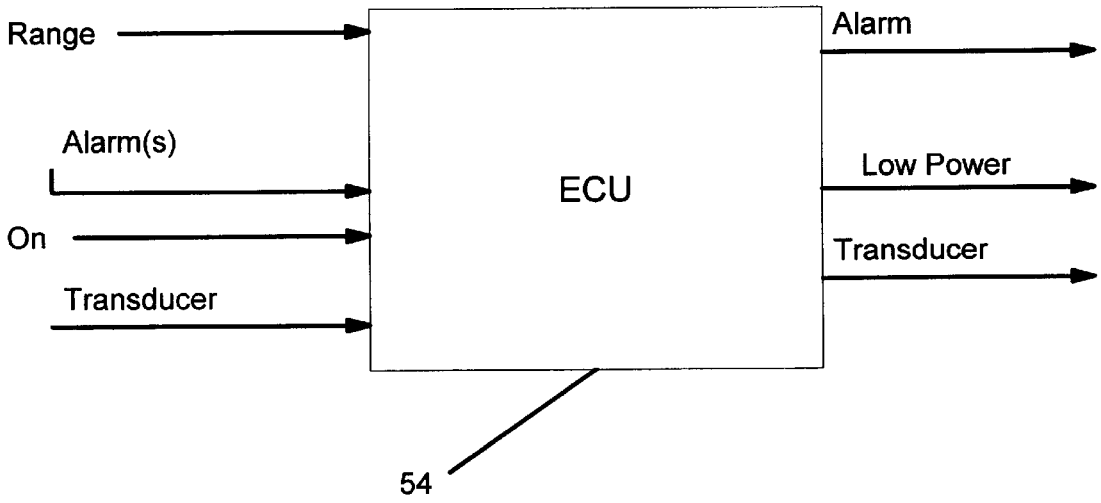
FIG. 6 schematically illustrates the electronic components of the controller.
Figure 7:
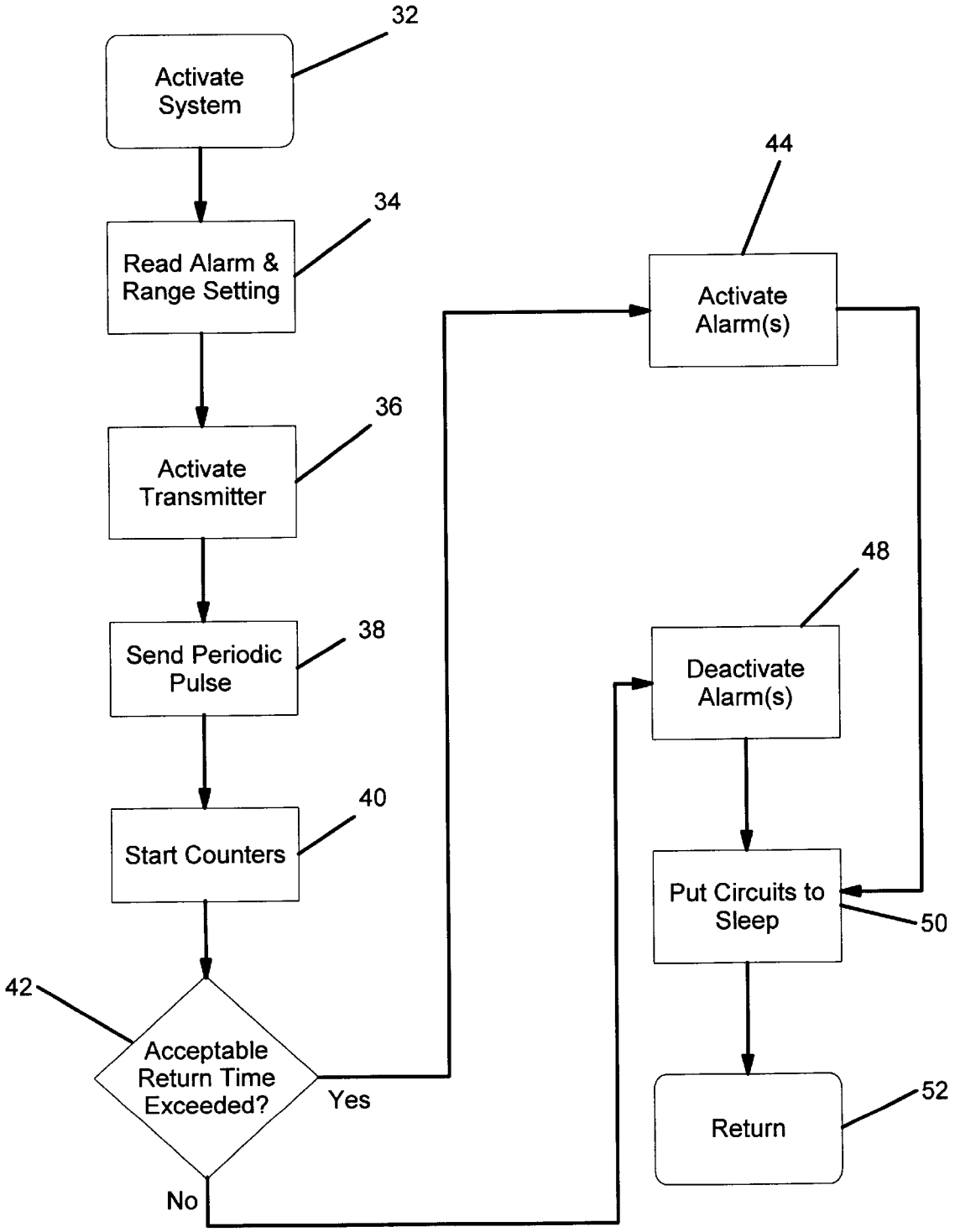
FIG. 7 is a flow chart outlining a method of monitoring a patient with the contactless monitoring system of FIG. 1.

Referring now to FIGS. 1, 6 and 7, the contactless patient monitoring system 10 provides an easy and inexpensive method of monitoring an individual seated in a chair. The patient monitoring system 10 is mounted on the back 12 of a stationary low back chair 14, stationary high back chair, vehicle headrest, or wheelchair, commode, etc. at a predetermined distance from the individual 16 to be monitored. The system and alarm are then activated in step 32 and the controller alarm setting is set to a desired distance range in step 34. Once set to a desired distance range, the alarm setting does not have to be reset unless the desire safe area is redefined. The transmitter is then automatically activated in step 36 to transmit a pulsed signal at a predetermined periodic time interval in step 38, preferably once every one-half second to once every second, toward a monitored individual and reflected back toward the receiver. The transmitted signal is not confined to any angle, signal frequency or signal strength. Because the patient monitoring system 10 measures only a specific, intensity-independent characteristic of the reflected signal, devices used to shield the monitoring system from other energy sources, which would be required in an intensity-based electronic monitoring systems, are not needed with the patient monitoring system 10. The individual 16 is continuously monitored, even if he or she is no longer within a predetermined space parameter defined by the system. Counters of the circuit are set in step 40 to enable it to detect whether the monitored individual is within the predetermined space parameter that defines and corresponds directly to defined threshold parameters such as, a preset maximum and/or minimum return time. The circuit then compares an actual characteristic of the reflected signal, such as the return time of the pulsed signals, with a preset threshold of the characteristic, such as preset a return time threshold parameter, in step 42.

If the actual parameter measured by the circuit is greater than a maximum threshold parameter and/or less than a minimum threshold parameter, the circuit activates an alarm generator in step 44 to trigger an alarm signal. The alarm signal generated may be a voice warning, an optical warning or, preferably a sound generated at a frequency within the range including from 480 Hz to 25 kHz, and preferably about 4 kHz. The procedure then goes to step 50 and the circuit is put to sleep. If the answer to the inquiry of step 42 is NO, indicating that the monitored individual has not left the safe area, the alarm generator is deactivated in step 48 and the alarm circuit is put to sleep in step 50 until the next pulse is generated via execution of the return step 52.

Although the time-based measurement is preferred, the system may alternatively measure a phase shift between the transmitted and received signals or a change in the angles of incidence of the transmitted and received signals.

Hence, if the measured characteristic is the phase shift between the transmitted and received signals, the phase shift of each transmitted and received signal is measured and compared to a preset phase shift threshold parameter. If a measured phase shift is outside of the preset phase shift threshold parameter, the alarm generator is activated. If the phase shift between the next transmitted and received signal is also outside the preset phase shift threshold, the alarm generator will continue to generate an alarm signal. If the phase shift between the next transmitted and received signal is within the defined phase shift threshold parameter, the alarm generator is reset.

Similarly, if the measured characteristic is the angle of incidence of the reflected signal, the angle of incidence of each transmitted and received signal is measured by the circuit, preferably using a position sensitive detector such as the Sharp GP2D02 position sensitive detector, and compared to the preset angle of incidence threshold parameter. If a measured angle of incidence is outside of the preset angle of incidence threshold parameter, the alarm generator is activated. If the angle of incidence of the next transmitted and received signal is also outside of the preset angle of incidence threshold parameter, the alarm generator continues to generate an alarm signal. If the next measured angle of incidence is within the preset angle of incidence threshold parameter, the alarm generator is reset.

The patient monitoring system 10 continues to monitor the individual 16, even if he or she is no longer within the predetermined space parameter. Therefore, unlike other electronic monitoring systems which only indicate the presence or absence of an individual at a specific point, an alarm signal generated by the patient monitoring system indicates that, although the monitored individual may still be present within the monitored area, he or she has gone outside the preset space parameter into an unsafe area. This feature provides much more specific and refined monitoring and also allows minimum and maximum predetermined distance parameters to be monitored simultaneously. It is also very precise, being capable of detecting location of the monitored individual 16 within 1 cm. The breadth of monitoring range, combined with the ability to measure a change in position as small as 1 cm, allows the patient monitoring system 10 to monitor an individual in a vehicle seat as effectively as an individual in a wheelchair.

What is claimed is:

1. A contactless monitoring system comprising:

(A) a controller which is configured to monitor an individual seated in a seat, said controller including (1) a transmitter which is configured to transmit a pulsed signal at intervals;

(2) a receiver which is configured to receive the reflected signals from the monitored individual; and, (3) a circuit which is coupled with the transmitter and the receiver and which is configured to a) measure the actual return time of each pulsed signal from the time of signal transmission toward the individual to the time of the receipt of the reflected signal from the individual, and b) compare the return time to a threshold return time parameter, wherein the threshold return time parameter corresponds directly to at least one boundary of a three-dimensional space parameter that corresponds to a location beyond which the monitored individual would move when in danger of leaving the seat; and (B) an alarm generator which is coupled with the circuit and which generates an alarm signal when the circuit determines that the return time of at least one pulsed signal exceeds the threshold return time parameter, thereby indicating that the monitored individual is in danger of leaving the seat.

2. A system as defined in claim 1, wherein the pulsed signal is an infrared light.

3. A system as defined in claim 1, wherein the pulsed signal is a sonic signal.

4. A system as defined in claim 1, wherein the controller is mounted on a low back chair.

5. A system as defined in claim 4, wherein the controller is mounted on said low back chair with a mounting apparatus comprising an extension strip mounted between said controller and the back of said low back chair.

6. A system as defined in claim 4, wherein the low back chair is one of a stationary chair and a wheelchair.

7. A system as defined in claim 1, wherein the controller is mounted on a high back seating apparatus.

8. A system as defined in claim 7, wherein said controller is received into a compartment formed within a headrest or lumbar support and is mounted on the back of said high back seating apparatus.

9. A system as defined in claim 7, wherein the high back seating apparatus is a vehicle seat.

10. A system as defined in claim 1, wherein the three-dimensional space parameter has an outer boundary which is variable, by varying the threshold return time parameter, within the range from approximately 6 inches to approximately 30 inches.

11. A system as defined in claim 1, wherein the threshold return time parameter corresponds directly to the sensitivity of the positional change of the monitor at an outer boundary of the three-dimensional predetermined space parameter.

12. The system as defined in claim 11, wherein the sensitivity of positional change is 1 cm.

13. A system as defined in claim 1, wherein the pulsed signals are transmitted at a rate of approximately one per second.

14. A system as defined by claim 1, wherein the pulsed signals are transmitted at a frequency of 20 kHz to 100 kHz.

15. A system as defined in claim 1, wherein the transducer is Polaroid's electrostatic transducer of environmental grade, 600 series, part #616342 & 607281 used in conjunction with a 6500 Series Transformer, part #619392 & 619391.

16. A system as defined in claim 1, wherein said alarm generator is reset by pushing a button mounted on said controller.

17. A system as defined in claim 1, wherein the transmitter and receiver are combined in a single transducer.

18. A contactless monitoring system comprising:

(A) a controller for monitoring an individual located within a specified spacing from the controller, said controller comprising (1) a single transducer which transmits reflectable pulsed sonic signals toward a monitored individual at intervals and which receives reflected signals from the monitored individual;

(2) a counter which is coupled with the transducer and which measures the actual return time of each pulsed signal and compares the return time of each pulsed signal with a preset return time range, wherein the preset return time range corresponds directly to at least two boundaries of a three dimensional predetermined space parameter, wherein at least one of the boundaries corresponds to a location beyond which the monitored individual would move when in danger of leaving the seat; and an alarm generator which is coupled with the counter and which generates an alarm signal when the counter measures a reflected pulsed signal having a return time which is outside the preset return time range, the alarm generator generating the alarm whenever the monitored individual moves outside of any of the monitored boundaries of the three dimensional space.

19. A method of monitoring a seated individual, comprising:

mounting a monitoring system at a distance from the individual to be monitored;

transmitting, from the monitoring system, a series of pulsed signals, wherein the transmitted signals are transmitted toward the monitored individual seated on a seating apparatus so that the pulsed signals are reflected off the monitored individual and back toward said monitoring system;

receiving the pulsed signals at the monitoring system;

comparing the return time of each pulsed signal to a threshold return time range which corresponds directly to at least one boundary of a three-dimensional predetermined space parameter that corresponds to a location beyond which the monitored individual would move when in danger of leaving the seat;

generating an alarm signal only if the return time of a pulsed signal is outside the threshold return time range, thereby indicating that the monitored individual is not within the three-dimensional space parameter, wherein an alarm signal is generated whenever the monitored individual is in danger of leaving the seat.

20. A method as defined in claim 19, further comprising deactivating the alarm and automatically resetting the alarm generator if the monitored individual returns to within said three-dimensional predetermined space parameter when subsequent pulses are detected.

21. A method as defined in claim 19, wherein the pulses are transmitted at intervals of not more than one second.

22. A method as defined in claim 19, wherein the pulsed signals are transmitted at a periodic pulsed rate of approximately one per second.

23. A contactless monitoring system comprising:

(A) a controller which is configured to monitor an individual seated in a seat, said controller including (1) a transmitter which is configured to transmit a pulsed signal at intervals;

(2) a receiver which is configured to receive reflected signals from the monitored individual; and, (3) a circuit which is coupled with the transmitter and with the receiver and which is configured to a) measure an intensity-independent characteristic of each pulsed signal that is transmitted from the transmitter, reflected from the monitored individual, and impinged upon the receiver, and b) compare the measured characteristic to a range of characteristics having a maximum threshold parameter of the measured characteristic and a minimum threshold parameter of the characteristic, wherein the threshold parameters correspond directly to at least two boundaries of a three-dimensional space parameter, wherein at least one of the boundaries corresponds to a location beyond which the monitored individual would move when in danger of leaving the seat; and (B) an alarm generator which is coupled with the circuit and which generates an alarm signal when the circuit determines that the measured characteristic of at least one pulsed signal is either less than the minimum threshold parameter or greater than the maximum threshold parameter, and wherein an alarm signal is generated whenever the monitored individual is in danger of leaving the seat.

24. A system as defined in claim 23, wherein the measured characteristic of each signal is a phase shift between the transmitted signal and the received signal, and wherein the threshold parameter range is a phase having a maximum threshold phase shift and minimum threshold phase shift, said alarm generator generating said alarm signal whenever the measured phase shift is determined as being either less than the minimum threshold phase shift or greater than the maximum threshold phase shift.

25. A system as defined in claim 23, wherein the measured characteristic of each signal is the angle of incidence of the reflected signal, and wherein the threshold parameter range is a range of threshold angles of incidence having a maximum threshold angle of incidence and minimum threshold angle of incidence, said alarm generator generating said alarm signal whenever the measured phase shift is determined as being either less than the minimum threshold angle of incidence or greater than the maximum threshold angle of incidence.

26. A system as defined in claim 25, wherein the circuit includes a Sharp GP2D02 position sensitive detector.

27. A system as defined in claim 23, wherein the measured characteristic of each signal is the return time between transmission of the reflected signal and receipt of the signal, and wherein the threshold parameter return time range having a maximum threshold return time and minimum return time, said alarm generator generating said alarm signal whenever the measured return time is determined as being either less than the minimum threshold return time or greater than the maximum threshold return time.

28. A system as defined in claim 23, wherein the transmitter and the receiver are combined in a single transducer.

29. A monitoring system as recited in claim 1, wherein the threshold time parameter is a time range having a minimum threshold return time and the maximum threshold return time, and wherein the alarm generator generates the alarm signal whenever the measured return time is determined as being either less than the minimum threshold return time or greater than the maximum threshold return time.

30. A method as defined in claim 19, wherein the alarm signal is generated immediately after determining that the return time of any one pulsed signal is outside of the predetermined range.

31. A method as defined in claim 19, wherein the transmitting and receiving steps are performed by a single transmitter and a single receiver located behind a forward-facing seated individual.

* * * * *